US009305694B2

(12) United States Patent
Shimizu

(10) Patent No.: US 9,305,694 B2
(45) Date of Patent: Apr. 5, 2016

(54) OIL-IMMERSED SOLENOID

(71) Applicant: KAWASAKI JUKOGYO KABUSHIKI KAISHA, Kobe-shi, Hyogo (JP)

(72) Inventor: Hiroaki Shimizu, Kakogawa (JP)

(73) Assignee: KAWASAKI JUKOGYO KABUSHIKI KAISHA, Kobe-shi (JP)

( * ) Notice: Subject to any disclaimer, the term of this patent is extended or adjusted under 35 U.S.C. 154(b) by 0 days.

(21) Appl. No.: 14/408,868

(22) PCT Filed: Apr. 30, 2014

(86) PCT No.: PCT/JP2014/061953
§ 371 (c)(1),
(2) Date: Dec. 17, 2014

(87) PCT Pub. No.: WO2014/192489
PCT Pub. Date: Dec. 4, 2014

(65) Prior Publication Data

US 2015/0179326 A1 Jun. 25, 2015

(30) Foreign Application Priority Data

May 28, 2013 (JP) ..... 2013-112079

(51) Int. Cl.
*H01F 3/00* (2006.01)
*H01F 7/128* (2006.01)
(Continued)

(52) U.S. Cl.
CPC ..... *H01F 7/128* (2013.01); *H01F 7/127* (2013.01); *H01F 7/1607* (2013.01)

(58) Field of Classification Search
CPC ..... F16K 31/02; F16K 31/06; H01F 7/129; H01F 3/00; H01F 7/08; H01H 5/00
USPC ..... 335/260
See application file for complete search history.

(56) References Cited

U.S. PATENT DOCUMENTS 4,044,324 A * 8/1977 Coors ..... H01F 7/1607 335/260
5,358,215 A * 10/1994 Buth ..... B60G 17/0525 251/129.15

(Continued)

FOREIGN PATENT DOCUMENTS

JP A-2000-193120 7/2000
JP A-2002-228036 8/2002

(Continued)

OTHER PUBLICATIONS

Aug. 12, 2014 International Search Report issued in International Patent Application No. PCT/JP2014/061953 (with translation).

*Primary Examiner* — Shawki S Ismail
*Assistant Examiner* — Lisa Homza
(74) *Attorney, Agent, or Firm* — Oliff PLC

(57) ABSTRACT

An oil-immersed solenoid is provided with a casing including a base, a cylinder, and a flange in an integral manner, a fixed magnetic pole, a plunger having an armature, a guide pipe, a coil unit including a bobbin around which a coil is wound, and a cover, the fixed magnetic pole is integrated with the casing, and in the state where the plunger, the guide pipe, the coil unit, and the cover are attached in the cylinder of the casing, a front end of the cylinder is swaged, thereby holding the plunger, the guide pipe, the coil unit, and the cover in the casing.

6 Claims, 15 Drawing Sheets

(51) Int. Cl.
*H01F 7/127* (2006.01)
*H01F 7/16* (2006.01)

(56) References Cited

U.S. PATENT DOCUMENTS 6,029,704 A * 2/2000 Kuroda ..... F16K 31/0613 137/625.65
6,564,443 B2 * 5/2003 Oishi ..... H01F 7/1607 29/596
7,611,121 B2 * 11/2009 Iwa ..... F04B 27/1804 251/129.15
7,701,314 B2 * 4/2010 Hazzard ..... H01F 7/128 335/241
8,469,334 B2 * 6/2013 Yamagata ..... H01F 7/1607 251/129.07
2003/0038260 A1 * 2/2003 Matsusaka ..... F16K 31/0624 251/129.15
2004/0113112 A1 * 6/2004 Hirata ..... F16K 31/0668 251/129.15
2010/0123535 A1 * 5/2010 Yamagata ..... H01F 7/081 335/260

FOREIGN PATENT DOCUMENTS

JP A-2006-300222 11/2006
JP A-2008-196597 8/2008

* cited by examiner

OIL-IMMERSED SOLENOID

TECHNICAL FIELD

The present invention relates to an oil-immersed solenoid used in a valve device for controlling hydraulic equipment for construction machinery and industrial machinery.

BACKGROUND OF THE INVENTION

As well known, oil-immersed solenoids are widely used in valve devices for controlling hydraulic equipment for construction machinery and industrial machinery. A generally-known oil-immersed solenoid includes a coil, a fixed magnetic pole, and an armature, and energizes the coil in the state where hydraulic oil is filled in a space that houses the armature, thereby causing the fixed magnetic pole to suck the armature so as to move a shaft fixed to the armature.

For example, Patent Document 1 discloses such an oil-immersed solenoid. As shown in FIG. 15, the solenoid 100 includes a casing 115 forged by integrating a base 111, an outer cylinder 112, a lower fixed magnetic pole 113 and a flange 114, an inner cylinder 120 jointed to the lower fixed magnetic pole 113 of the casing 115, a plunger 130 having an armature 131 housed in the inner cylinder 120, a bobbin 142 around which a coil 141 is wound, and a cover 150, and energizes the coil 141 to move the plunger 130.

Patent Document 1: JP 2006-300222 A

However, in the solenoid 100 described in Patent Document 1, as shown in FIG. 15, the inner cylinder 120 is formed by brazing an upper fixed magnetic pole 121 as a magnetic body to a cylinder 122 as a nonmagnetic body, and the inner cylinder 120 is brazed to the lower fixed magnetic pole 113 of the casing 115.

Then, the plunger 130 is inserted into the inner cylinder 120 jointed to the casing 115, the bobbin 142 around which the coil 141 is wound is fitted to the outer circumference of the inner cylinder 120, the cover 150 is placed thereon and then, a front end of the outer cylinder 112 is swaged to the cover 150 to assemble the solenoid 100.

In the solenoid 100 thus assembled, the inner cylinder 120 is formed by brazing and the inner cylinder 120 is brazed to the lower magnetic pole 113 of the casing 115. Since multiple times of brazing is required, the number of man-hours needed for assembling is large, disadvantageously increasing assembling costs.

Therefore, an object of the present invention is to provide an oil-immersed solenoid that can be easily assembled, greatly reducing the number of man-hours needed for assembling, and in turn, decreasing assembly costs.

SUMMARY OF THE INVENTION

To attain the object, the present invention is configured as follows.

Firstly, a first aspect of the present invention provides an oil-immersed solenoid used for hydraulic control equipment, the oil-immersed solenoid including: a casing including a base, a cylindrical cylinder extending from the base, and a flange extending from the base to an outside of the cylinder in an integral manner; a fixed magnetic pole disposed to extend from the base into the cylinder; a plunger including a shaft inserted into an insertion hole extending along an axis of the fixed magnetic pole, and an armature to which the shaft is fixed; a cylindrical guide pipe fitted to an outer circumference of the fixed magnetic pole to cover the plunger; a coil unit including a main body around which a coil is wound, and a connector provided on an outer circumferential face of the main body; and a cover disposed in the cylinder to cover the guide pipe and the coil unit from an opposite side to the base of the casing, wherein the fixed magnetic pole is integrated with the casing or the fixed magnetic pole is attached to the casing, the cylinder of the casing has a notch cut in a circumferential direction to correspond to the connector of the coil unit, and the plunger is attached in the cylinder of the casing so as to insert the shaft into the insertion hole of the fixed magnetic pole, the guide pipe is fitted to the outer circumference of the fixed magnetic pole to cover the plunger, the coil unit is inserted into a gap between the cylinder of the casing and the guide pipe, the cover is attached to cover the guide pipe and the coil unit, and in this state, a front end of the cylinder is swaged to the cover, to hold the plunger, the guide pipe, the coil unit, and the cover in the casing.

Moreover, a second aspect of the present invention is directed to the oil-immersed solenoid according to the first aspect, wherein a yoke is integrated with the coil unit, the yoke disposed adjacent to the main body on a side where the cover is arranged, and having an outer circumference of a larger outer diameter than the coil unit, and a step engaged with the outer circumference of the yoke is formed on an inner face of the cylinder of the casing.

Further, a third aspect of the present invention is directed to the oil-immersed solenoid according to the first or second aspect, wherein the coil unit has a recess in its opposed face to the base of the casing, and a projection protruding from the base of the recess further than the opposed face, in the recess.

Furthermore, a fourth aspect of the present invention is directed to the oil-immersed solenoid according to any one of the first to third aspects, wherein the cover has a protrusion protruding from an edge of a face of the cover, the face making contact with the front end of the cylinder when the front end of the cylinder is swaged.

Furthermore, a fifth aspect of the present invention is directed to the oil-immersed solenoid according to any one of the first to fourth aspects, the cover has a groove on an edge of a face of the cover, the face making contact with the front end of the cylinder when the front end of the cylinder is swaged, the groove being axially dented further than a remaining area of the edge.

Furthermore, a sixth aspect of the present invention is directed to the oil-immersed solenoid according to any one of the first to fifth aspects, wherein the guide pipe includes a large-diameter portion fitted to the fixed magnetic pole and a small-diameter portion fitted to the armature of the plunger, and both axial ends of the small-diameter portion are pressed by hydraulic oil.

ADVANTAGE OF THE INVENTION

With such configuration, the present invention can achieve following effects.

According to the first aspect of the present invention, by integrating the fixed magnetic pole with the casing or attaching the fixed magnetic pole to the casing, attaching the plunger in the cylinder of the casing, fitting the guide pipe to the outer circumferences of the fixed magnetic pole and the plunger, fitting the coil unit to the outer circumference of the guide pipe, attaching the cover so as to cover the guide pipe and the coil unit, and swaging the front end of the cylinder to the cover, the plunger, the guide pipe, the coil unit, and the cover are held in the casing. Since the solenoid can be assembled so easily by sequentially inserting the plunger, the guide pipe, the coil unit, and the cover into the casing and then, swaging the front end of the cylinder of the casing, the number of man-hours for assembling can be greatly decreased to reduce assembling costs.

According to the second aspect of the present invention, since the yoke that is disposed adjacent to the main body on the side where the cover is arranged and has the outer circumference of the larger outer diameter than the coil unit is integrated with the coil unit, and the step engaged with the outer circumference of the yoke is formed on the inner face of the cylinder of the casing, in the case where the yoke is disposed in the solenoid as compared to the case where the yoke and the coil unit are separate members, the number of man-hours for assembling can be reduced and further, the yoke and the coil unit can be held at a predetermined position, preventing rattle. Moreover, since only the yoke receives a pressing force at swaging, and the coil unit is not subjected to the pressing force, deformation of the coil unit can be prevented.

According to the third aspect of the present invention, since the coil unit has the recess in the end face opposed to the base of the casing, and the projection protruding from the base of the recess further than the opposed face in the recess, when the front end of the cylinder of the casing is swaged to the cover, the projection of the coil unit is squashed by the base of the casing such that the coil unit is held by the casing, thereby holding the coil unit at the predetermined position to suppress rattle. Further, it is possible to prevent the coil unit from oscillating when an external load acts on the solenoid.

According to the fourth aspect of the present invention, since the cover has, on the edge of the face of the cover against which the front end of the cylinder contacts when the front end of the cylinder is swaged, the protrusion protruding from the face, the front end of the cylinder can be swaged along the protrusion in consideration that the front end of the cylinder is returned by spring back, and the front end of the cylinder can be bent at a predetermined angle with high accuracy.

According to the fifth aspect of the present invention, since the cover has, on the edge of the face of the cover against which the front end of the cylinder contacts when the front end of the cylinder is swaged, the groove axially dented further than the remaining area of the edge, when the front end of the cylinder is swaged to the cover, the front end of the cylinder can be dug into the groove of the cover, preventing rotation of the cover relatively easily without changing an assembling process.

According to the sixth aspect of the present invention, since the guide pipe has the large-diameter portion fitted to the fixed magnetic pole and the small-diameter portion fitted to the armature of the plunger, and both axial ends of the small-diameter portion are pressed by hydraulic oil, a uniform pressing force acts on the both axial ends of the small-diameter portion, preventing the movement of the guide pipe to improve the reliability of the solenoid.

EMBODIMENT OF THE INVENTION

An embodiment of the present invention will be described with reference to appended figures.

Figure 1:
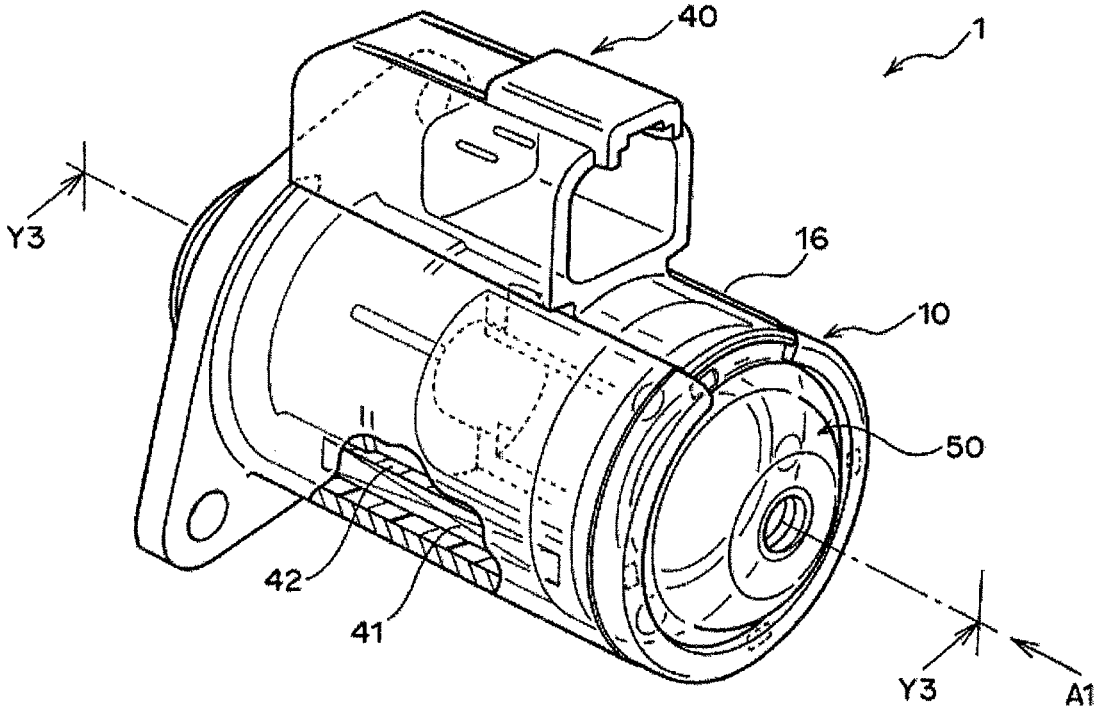
FIG. 1 is a perspective view of an oil-immersed solenoid in accordance with the embodiment of the present invention.
Figure 2:
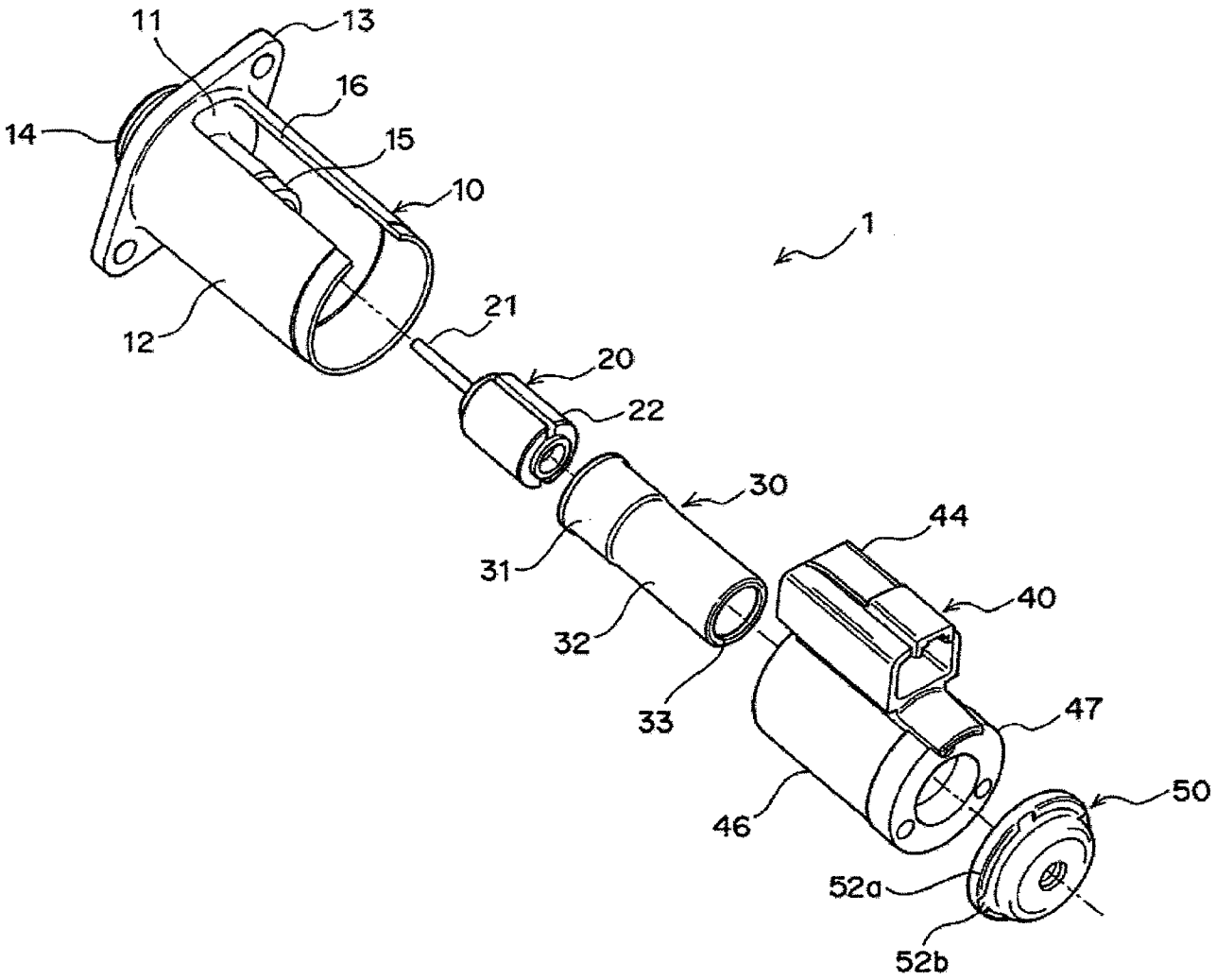
FIG. 2 is an exploded perspective view of the solenoid shown in FIG. 1.
Figure 3:
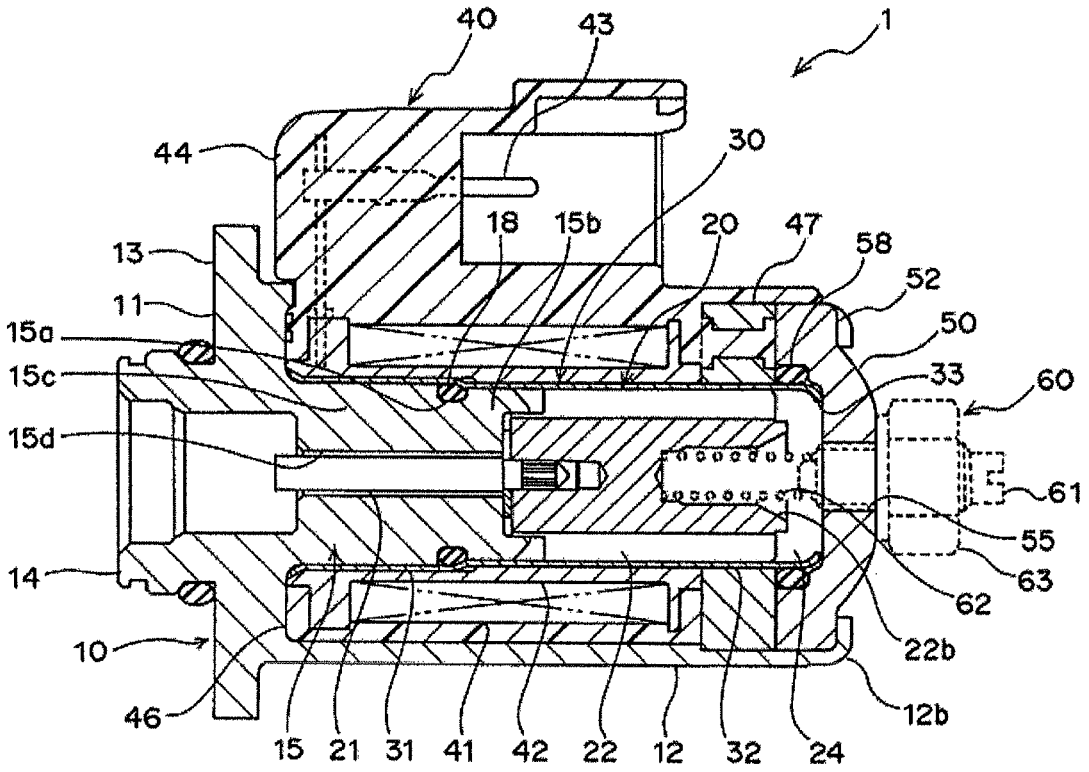
FIG. 3 is a sectional view of the solenoid taken along a line Y3-Y3 in FIG. 1.
Figure 4:
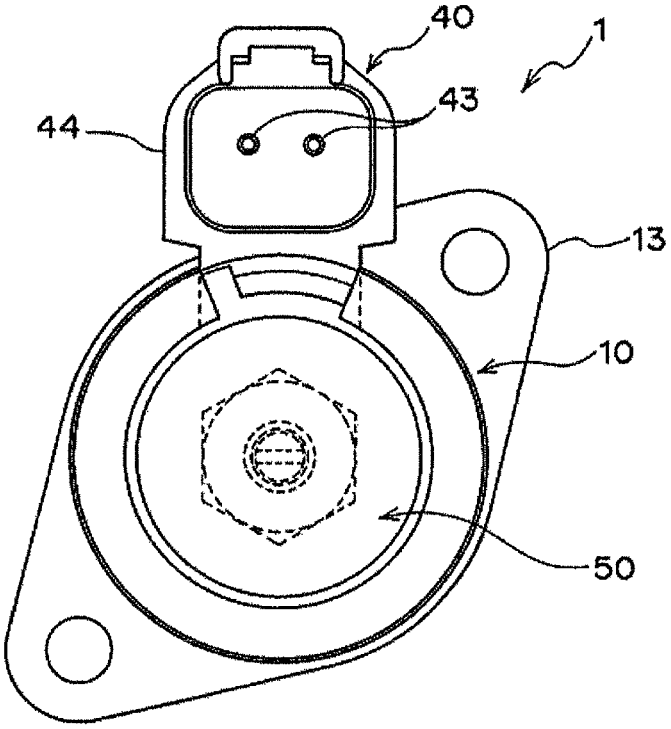
FIG. 4 is a front view of the solenoid when viewed from a direction A1 in FIG. 1.

FIG. 1 is a perspective view of an oil-immersed solenoid in accordance with the embodiment of the present invention. FIG. 2 is an exploded perspective view of the solenoid shown in FIG. 1. FIG. 3 is a sectional view of the solenoid taken along a line Y3-Y3 in FIG. 1. FIG. 4 is a front view of the solenoid when viewed from a direction A1 in FIG. 1. FIG. 3 and FIG. 4 show a biasing force adjusting mechanism for adjusting a biasing force of the plunger in a broken line.

As shown in FIG. 1 to FIG. 4, the oil-immersed solenoid 1 in accordance with the embodiment of the present invention is used in a valve device (hydraulic control equipment) for controlling hydraulic equipment for construction machinery, and includes a casing 10, a plunger 20, a guide pipe 30, a coil unit 40, and a cover 50, as main constituents.

The casing 10 has a substantially disc-like base 11, a substantially cylindrical cylinder 12 extending from the edge of the base 11, a flange 13 extending from the base 11 to the outside of the cylinder 12, and an attachment portion 14 extending from the base 11 to the opposite side to the cylinder 12. In the casing 10 formed by forging a magnetic material such as carbon steel, the base 11, the cylinder 12, the flange 13, and the attachment portion 14 are integrally formed.

A fixed magnetic pole 15, in which magnetic poles are generated by a coil 41 of the coil unit 40, is disposed in the cylinder 12 of the casing 10, and extends from the base 11 in a substantially cylindrical manner. The fixed magnetic pole 15 has an annular groove 15*a* having the outer circumference to which a sealing member 18 is attached, and a front end portion 15*b* closer to the front end than the annular groove 15*a* has a smaller outer diameter than a bottom portion 15*c* closer to the base 11 than the annular groove 15*a*. An axially-extending insertion hole 15*d* is formed at the center of the fixed magnetic pole 15.

In the present embodiment, the fixed magnetic pole 15 is also made of a magnetic material such as carbon steel, and is integrated with the casing 10 by forging. It is noted that the fixed magnetic pole 15 is not necessarily integrated with the casing 10, and the fixed magnetic pole 15 may be attached to the casing 10.

The plunger 20 has an armature 22 to which a shaft 21 to be inserted into the insertion hole 15*d* of the fixed magnetic pole 15 is fixed. The shaft 21 is inserted into the insertion hole 15*d* of the fixed magnetic pole 15, and its front end is connected to a spool of the valve device not shown.

Figure 5:
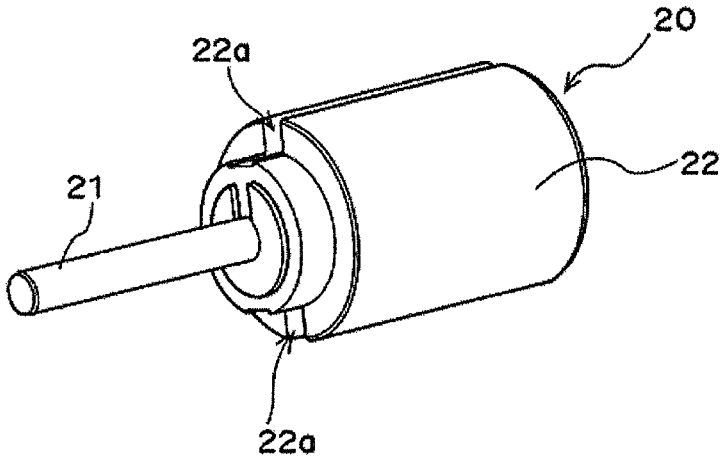
FIG. 5 is a perspective view of a plunger of the solenoid.

FIG. 5 is a perspective view of the plunger of the solenoid. As shown in FIG. 5, the armature 22 of the plunger 20 is substantially cylindrical, and two axially-extending communicating grooves 22*a* are axisymmetrically formed in the side face of the armature 22. The communicating grooves 22*a* is provided such that, when the armature 22 moves in the state where hydraulic oil is filled in a space 24 that houses the plunger 20, the hydraulic oil can move through the communicating grooves 22*a*.

In the state where the shaft 21 and the armature 22 are disposed on the same axis in the plunger 20, the shaft 21 is press-fitted into the armature 22 in an integral manner. The shaft 21 is made of a nonmagnetic material such as stainless steel, and the armature 22 is made of a magnetic material such as carbon steel.

The guide pipe 30 has a substantially cylindrical shape corresponding to the shapes of the fixed magnetic pole 15 and the armature 22. The guide pipe 30 has a large-diameter portion 31 fitted to the bottom portion 15*c* of the fixed magnetic pole 15, and a small-diameter portion 32 fitted to the front end portion 15*b* of the fixed magnetic pole 15 and the armature 22 of the plunger 20. An inner diameter of the large-diameter portion 31 is larger than an inner diameter of the small-diameter portion 32 by the thickness of the guide pipe 30, and the inner diameter of the large-diameter portion 31 is almost equal to an outer diameter of the small-diameter portion 32.

The guide pipe 30 is fitted to outer circumferences of the fixed magnetic pole 15 and the plunger 20 such that an end on the side of the large-diameter portion 31 contacts the base 11 of the casing 10, and when the guide pipe 30 is fitted to outer circumferences of the fixed magnetic pole 15 and the plunger 20, the guide pipe 30 defines a space 24 in which the armature 22 of the plunger 20 moves axially.

In the present embodiment, the guide pipe 30 is formed by deep-drawing a nonmagnetic material such as stainless steel into a bottomed cylinder and then, making an opening 33 on its bottom by punching. The guide pipe 30 may be a bottomed cylinder without an opening on its bottom.

Figure 6:
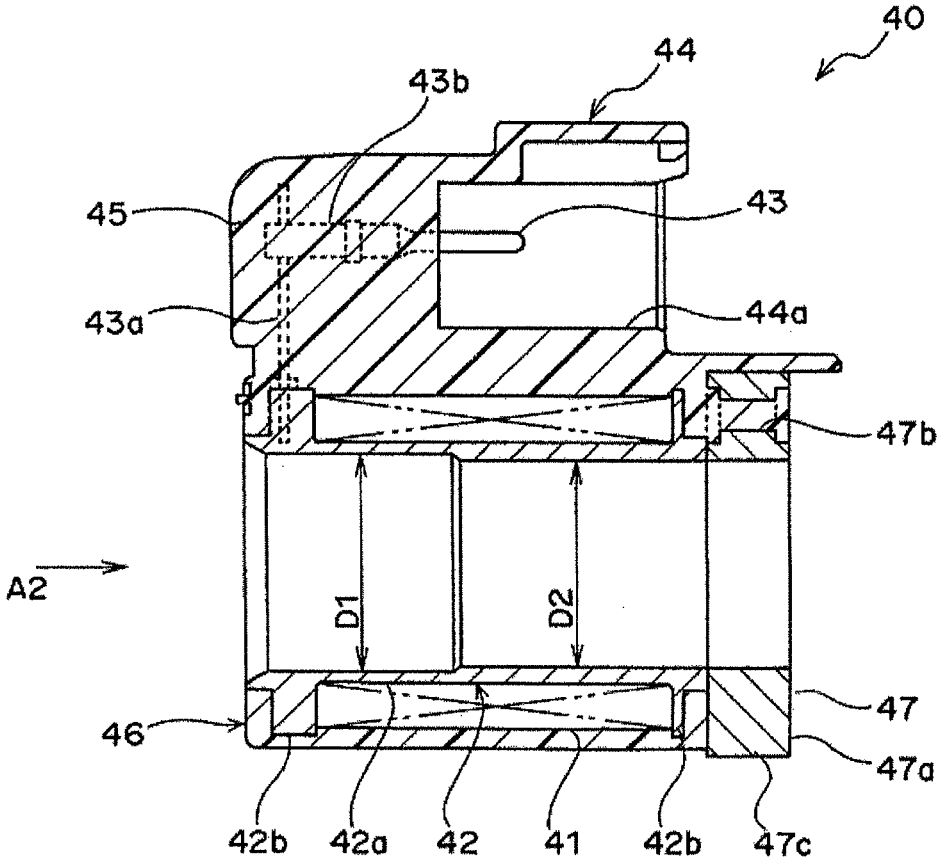
FIG. 6 is a sectional view of a coil unit of the solenoid.

FIG. 6 is a sectional view of the coil unit of the solenoid. As shown in FIG. 6, the coil unit 40 includes a bobbin 42 around which the coil 41 is wound, and the bobbin 42 has a substantially cylindrical cylinder 42*a* around which the coil 41 is wound, and flanges 42*b* at both axial ends of the cylinder 42*a* so as to extend outward from the cylinder 42*a*.

In the bobbin 42, an inner diameter D1 of the cylinder 42*a* is made larger than the outer diameter of the large-diameter portion 31 of the guide pipe 30, and an inner diameter D2 of the cylinder 42*a* is made larger than the outer diameter of the small-diameter portion 32 of the guide pipe 30. The coil unit 40 is configured by fitting the bobbin 42 to the outer circumference of the guide pipe 30.

The coil unit 40 further includes a connector 44 with a terminal 43 for supplying current to the coil 41. The terminal 43 is configured of a first terminal piece 43*a* that is connected to the coil 41 and extends outward from the flange 42*b* of the bobbin 42 and a second terminal piece 43*b* that is connected to the first terminal piece 43*a* and extends along the axis of the bobbin 42, and a front end of the second terminal piece 43*b* protrudes into a plug connection port 44*a*.

The coil 41, the first terminal piece 43*a*, and the second terminal piece 43*b* each are made of a conductive material such as copper, and the bobbin 42 is made of a nonmagnetic material such as thermoplastic synthetic resin. The coil unit 40 is insert-molded by using thermoplastic synthetic resin in the state where the first terminal piece 43*a* and the second terminal piece 43*b* are assembled to the bobbin 42 around which the coil 41 is wound, to have a substantially cylindrical main body 46 formed by covering the coil 41 and the bobbin 42 with a mold layer 45, and the connector 44 formed by covering the terminal 43 with the mold layer 45.

The outer circumference of the main body 46 is inserted into the cylinder 12 of the casing 10. The connector 44 protrudes to the outside of the cylinder 12 of the casing 10 through a notch 16 formed by cutting the cylinder 12 of the casing 10 in the circumferential direction so as to correspond to the connector 44.

A yoke 47 is disposed adjacent to the main body 46 of the coil unit 40 on the side where the cover 50 is arranged. The yoke 47 has a ring-like annular portion 47*a* made of a magnetic material such as carbon steel, and a plurality of through holes 47*b* axially penetrate the annular portion 47*a*. In the present embodiment, the three through holes 47*b* are formed at regular intervals in the circumferential direction.

In the present embodiment, the coil unit 40 is insert-molded in the state where the first terminal piece 43*a* and the second terminal piece 43*b* are assembled to the bobbin 42 around which the coil 41 is wound, and the yoke 47 is disposed adjacent to the bobbin 42, to form the mold layer 45 in the through holes 47*b* of the yoke 47 and integrate the yoke 47 with the coil unit 40.

Figure 7:
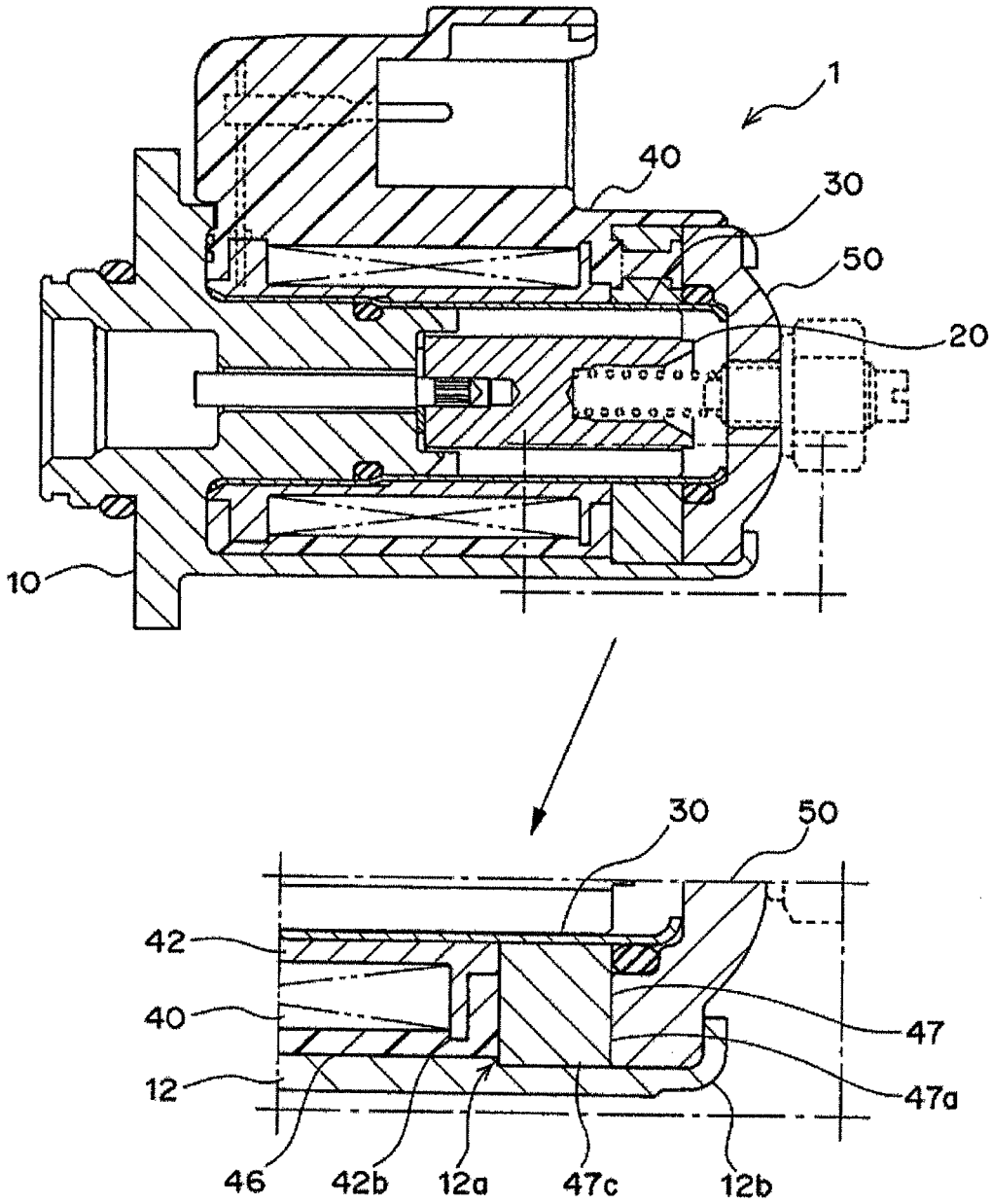
FIG. 7 is an enlarged view of a main part of the solenoid.

FIG. 7 is an enlarged view of a main part of the solenoid. As shown in FIG. 7, an inner diameter of the yoke 47 is almost equal to an inner diameter of the adjacent bobbin 42, an outer diameter of the yoke 47 is larger than an outer diameter of the main body 46 of the coil unit 40, and the yoke 47 has an outer circumference 47*c* that has a larger outer diameter than the coil unit 40.

A step 12*a* to be engaged with the outer circumference 47*c* of the yoke 47 is formed on an inner face of the cylinder 12 of the casing 10, and when the coil unit 40 is assembled to the casing 10, the outer circumference 47*c* of the yoke 47 integrated with the coil unit 40 contacts the step 12*a* of the cylinder 12.

By integrating the yoke 47 having the outer circumference 47*c* disposed adjacent to the main body 46 on the side where the cover 50 is arranged, and the coil unit 40 with each other, and forming the step 12*a* to be engaged with the outer circumference 47*c* of the yoke 47 on the inner face of the cylinder 12 of the casing 10, in the case where the yoke 47 is disposed in the solenoid 1 as compared to the case where the yoke 47 and the coil unit 40 are separate members, the number of man-hours for assembling can be reduced and further, the yoke 47 and the coil unit 40 can be held at a predetermined position, preventing rattle. Moreover, since only the yoke 47 receives a pressing force at swaging, and the coil unit 40 is not subjected to the pressing force, deformation of the coil unit 40 can be prevented.

Figure 8:
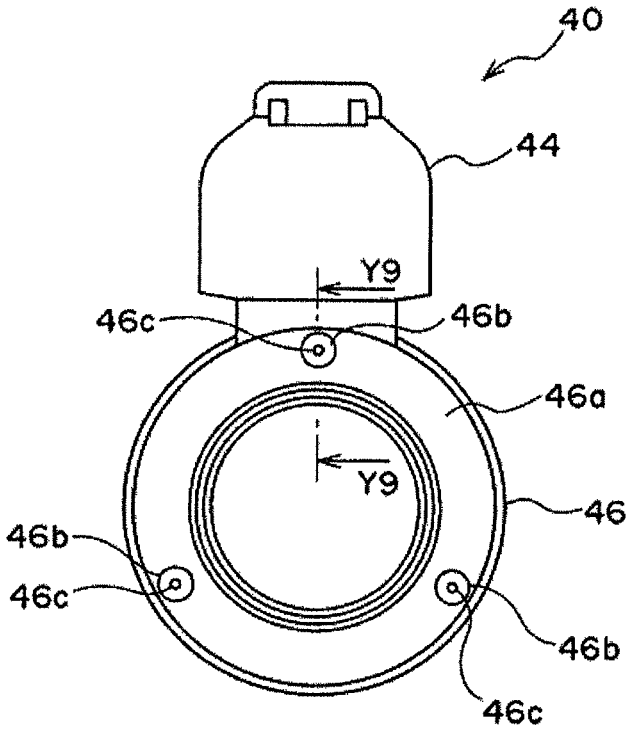
FIG. 8 is a front view of the coil unit when viewed from a direction A2 in FIG. 6.
Figure 9:
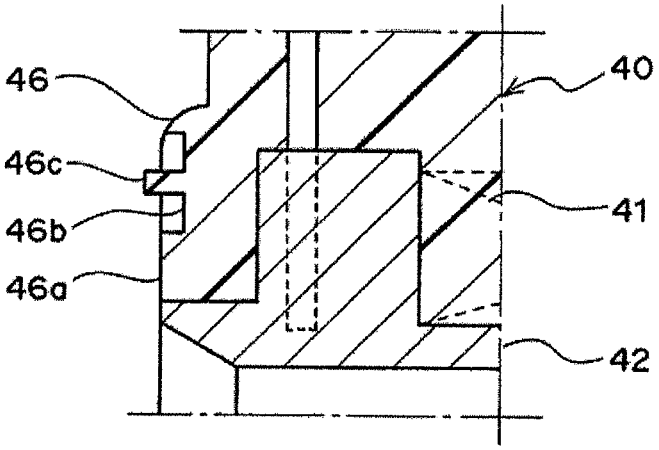
FIG. 9 is a sectional view of the coil unit taken along a line Y9-Y9 in FIG. 8.

FIG. 8 is a front view of the coil unit when viewed from a direction A2 in FIG. 6. FIG. 9 is a sectional view of the coil unit taken along a line Y9-Y9 in FIG. 8. As shown in FIG. 8 and FIG. 9, the coil unit 40 has an end face 46*a* on the opposite side to an end face of the main body 46 on which the yoke 47 is disposed, cylindrical recesses 46*b* are opened from the end face 46*a*, and cylindrical projections 46*c* axially extending from bases of the respective recesses 46*b* protrude beyond the end face 46*a* of the main body 46. The three recesses 46*b* and the three projections 46*c* are formed at regular intervals in the circumferential direction on the end face 46*a* of the main body 46.

Figure 10:
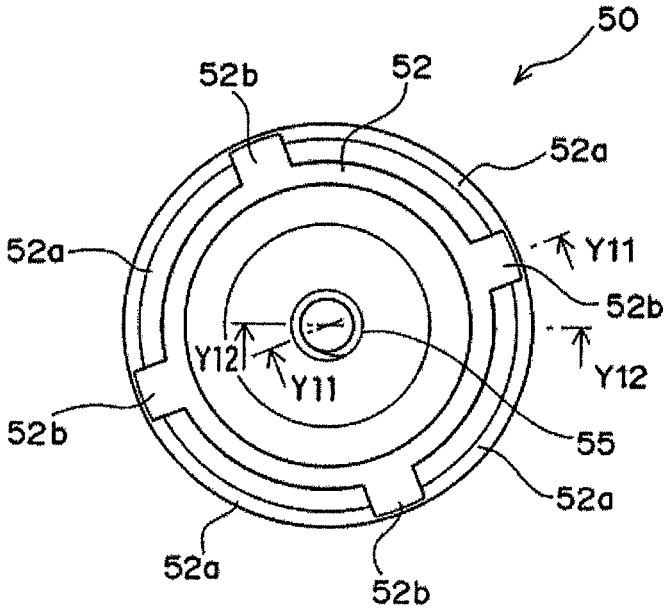
FIG. 10 is a front view of the cover of the solenoid.
Figure 11:
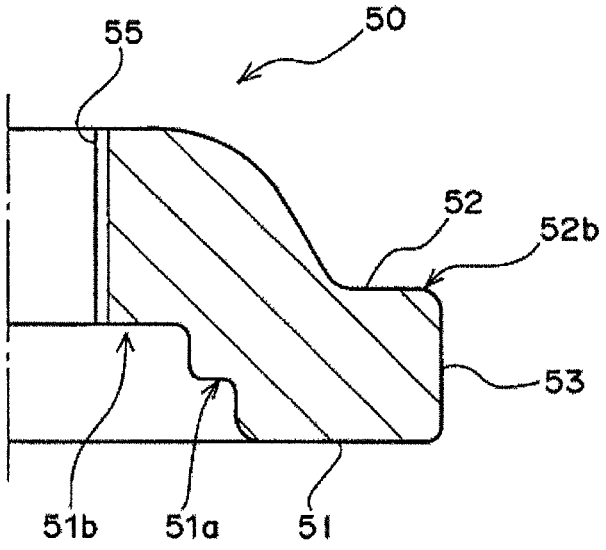
FIG. 11 is a sectional view of the cover taken along a line Y11-Y11 in FIG. 10.
Figure 12:
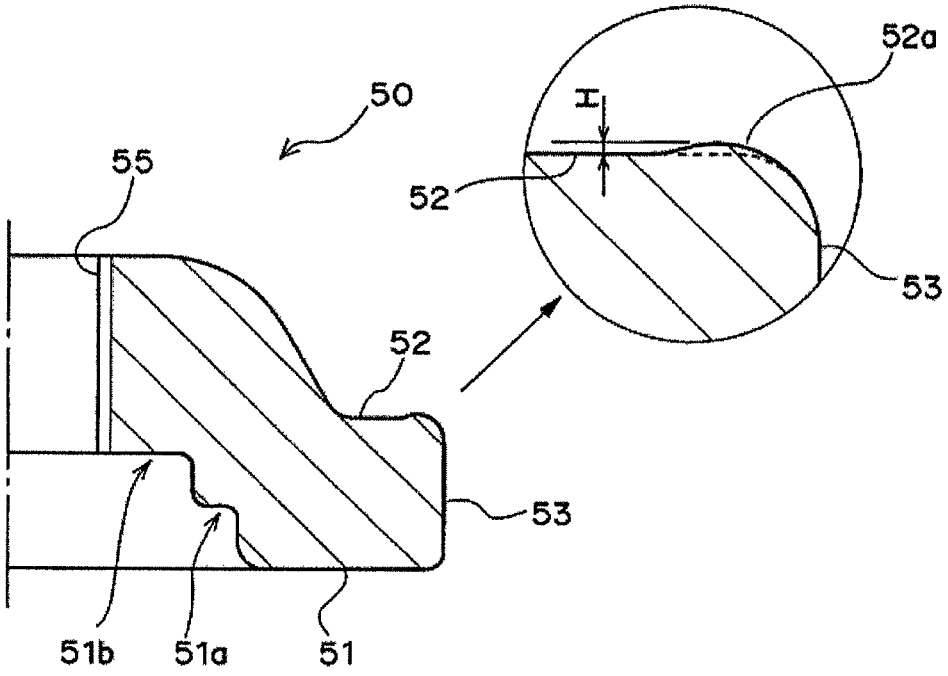
FIG. 12 is a sectional view of the cover taken along a line Y12-Y12 in FIG. 10.

FIG. 10 is a front view of the cover of the solenoid. FIG. 11 is a sectional view of the cover taken along a line Y11-Y11 in FIG. 10. FIG. 12 is a sectional view of the cover taken along a line Y12-Y12 in FIG. 10.

As shown in FIG. 10 to FIG. 12, the cover 50 is made of a nonmagnetic material such as stainless steel or a magnetic material such as iron, and is substantially shaped like a disc including a bottom face 51, a top face 52, and a side face 53. As shown in FIG. 3, the cover 50 is disposed in the cylinder 12 so as to cover the guide pipe 30 and the coil unit 40 from the opposite side to the base 11 of the casing 10, and when a front end 12*b* of the cylinder 12 of the casing 10 is swaged, as described later, the bottom face 51 contacts the yoke 47 integrated with the coil unit 40, and the top face 52 contacts the front end 12*b* of the cylinder 12.

The bottom face 51 of the cover 50 has a cylindrical first groove 51*a* opened from the bottom face 51 toward the top face 52, and a cylindrical second groove 51*b* opened from the first groove 51*a* toward the top face 52. The first groove 51*a* is formed to receive a sealing member 58, and the second groove 51*b* is formed to receive an end of the small-diameter portion 32 on the side of the guide pipe 30.

The top face 52 of the cover 50 is a face against which the front end 12*b* of the cylinder 12 contacts, and as shown in FIG. 12, the cover 50 has a protrusion 52*a* that extends along the edge of a face 52 in the circumferential direction and protrudes from the face 52 by a predetermined height H. Thus, the front end 12*b* of the cylinder 12 can be swaged along the protrusion 52*a* in consideration that the front end 12*b* of the cylinder 12 is returned by spring back after swaging, the front end 12*b* of the cylinder 12 can be bent at a predetermined angle, 90 degrees in the present embodiment, with high accuracy.

The edge of the face 52 of the cover 50 further has, on the edge, grooves 52*b* axially dented further than a remaining area of the edge. In the present embodiment, as shown in FIG. 10, the protrusion 52*a* formed on the edge of the face 52 is partially cut in the circumferential direction, and the cut portions of the protrusion 52*a* constitute the groove 52*b*. The four grooves 52*b* are formed on the cover 50 at regular intervals in the circumferential direction.

Thus, when the front end 12*b* of the cylinder 12 is swaged to the cover 50, the front end 12*b* of the cylinder 12 can be dug into the grooves 52*b* of the cover 50, preventing rotation of the cover 50 relatively easily without changing an assembling process.

As shown in FIG. 3, a biasing force adjusting mechanism 60 for adjusting the biasing force of the plunger 20 is attached to the cover 50. The biasing force adjusting mechanism 60 is configured of an adjusting screw 61 screwed into a screw portion 55 of the cover 50, and a spring 62 that is mounted to the adjusting screw 61 and is attached to an attachment groove 22*b* formed at the rear end of the armature 22.

The biasing force adjusting mechanism 60 rotates the adjusting screw 61 to adjust the biasing force of the spring 62, thereby adjusting the biasing force of the plunger 20. A seal nut 63 is screwed to the adjusting screw 61 to seal the adjusting screw 61 and the screw portion 55 of the cover 50.

In the oil-immersed solenoid 1 thus formed, which includes the casing 10, the plunger 20, the guide pipe 30, the coil unit 40, and the cover 50, the front end 12*b* of the cylinder 12 of the casing 10 is swaged to the cover 50, and is bent along the top face 52 of the cover 50.

In the oil-immersed solenoid 1, as shown in FIG. 3, in the state where the plunger 20, the guide pipe 30, the coil unit 40 integrated with the yoke 47, and the cover 50 are assembled in the casing 10, hydraulic oil is filled in the space 24 that houses the plunger 20.

Figure 13:
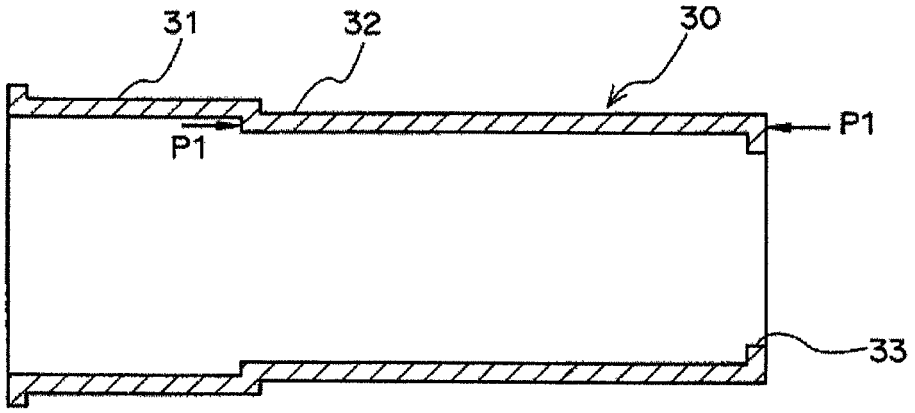
FIG. 13 is a sectional view schematically showing a guide pipe of the solenoid.

FIG. 13 is a sectional view schematically showing the guide pipe of the solenoid. In the guide pipe 30, the inner face of the large-diameter portion 31 is sealed with the sealing member 18, and the outer face of the small-diameter portion 32 is sealed with the sealing member 58. When the oil-immersed solenoid 1 is filled with hydraulic oil, as shown in FIG. 13, the both axial ends of the small-diameter portion 32 of the guide pipe 30 are equally pressed by the hydraulic oil with a pressing force P1.

Since the small-diameter portion 32 of the guide pipe 30 is subjected to the uniform pressing force of the hydraulic oil, movement of the guide pipe 30 is prevented, and as compared to the case where the guide pipe 30 is moved by the pressing force of the hydraulic oil, the reliability of the solenoid 1 can be improved.

In the oil-immersed solenoid 1 thus configured, current is supplied to the coil 41 through the terminal 43 to generate magnetic poles in the fixed magnetic pole 15 and a suction force corresponding to the current, and the armature 22 can be sucked by the suction force to move the plunger 20.

Next, a method of assembling the oil-immersed solenoid 1 in the present embodiment will be described.

Figure 14:
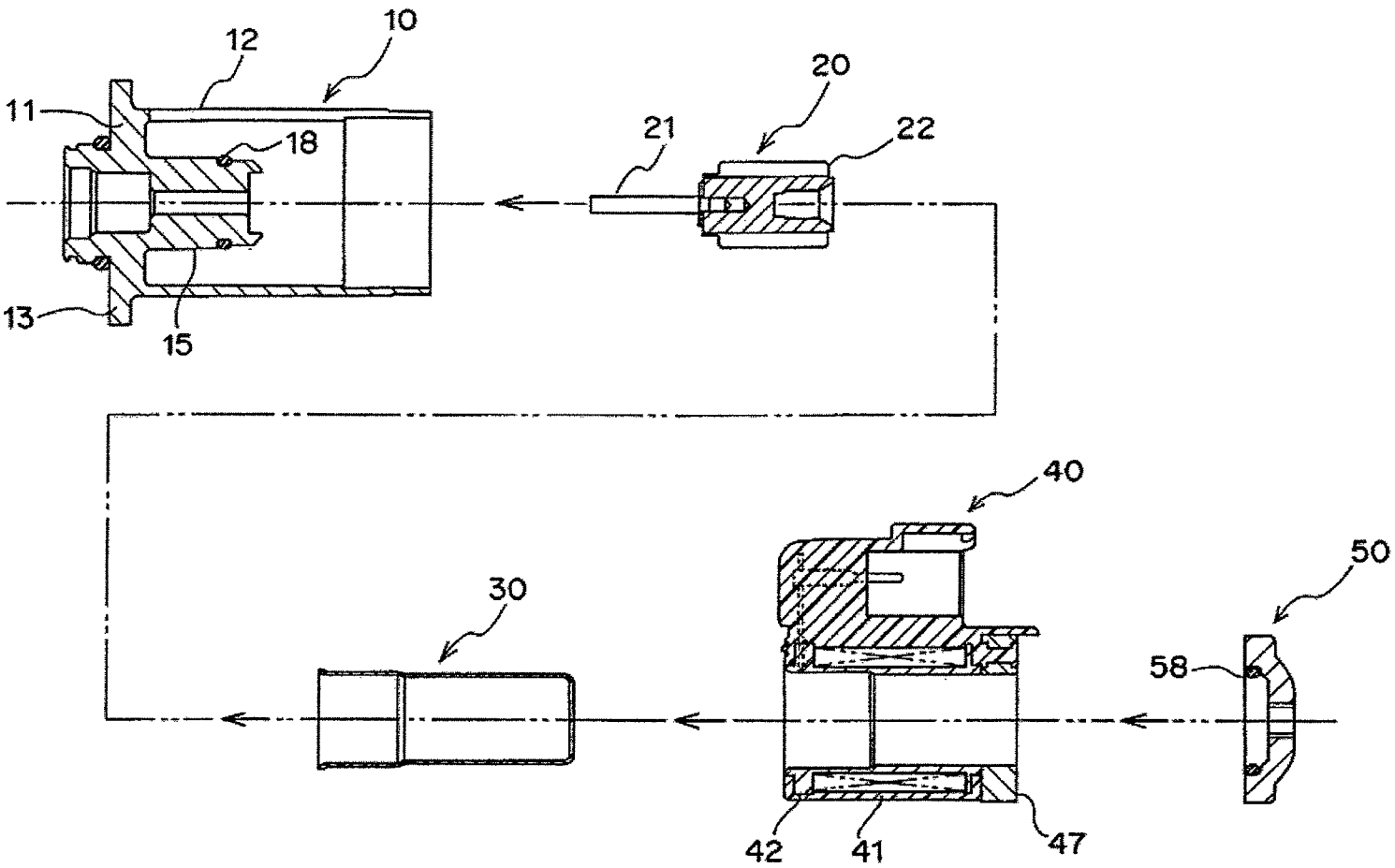
FIG. 14 is a view illustrating a method of assembling the solenoid.
Figure 15:
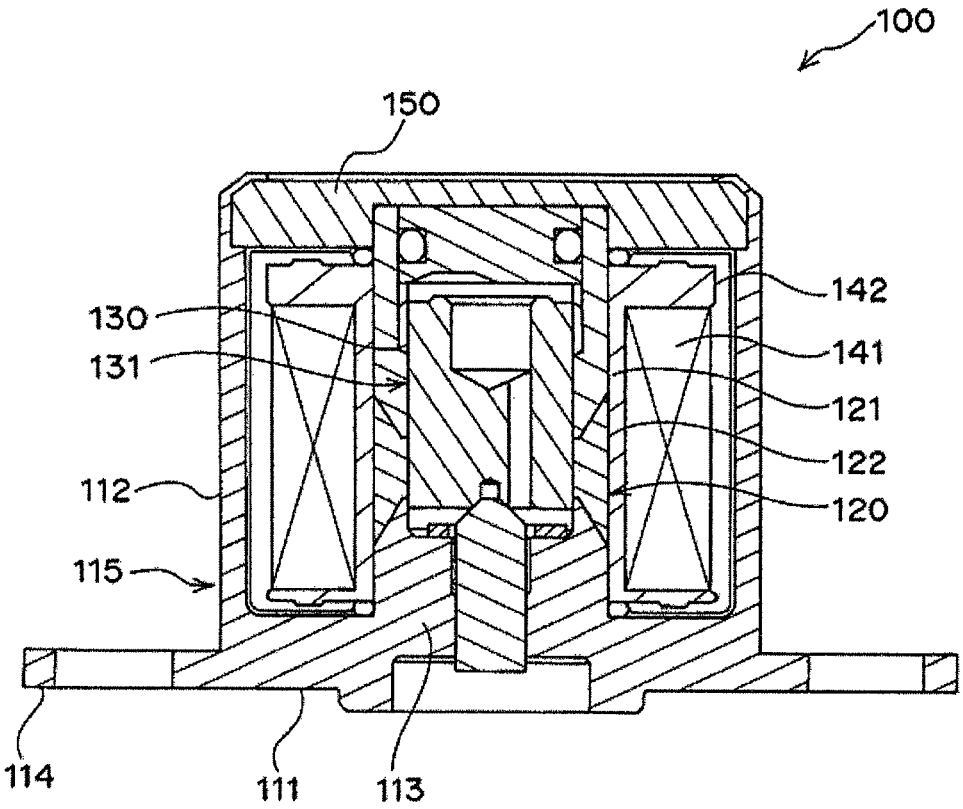
FIG. 15 is a sectional view of a conventional oil-immersed solenoid.

FIG. 14 is a view illustrating the method of assembling the solenoid, and shows cross sections of the casing 10, the plunger 20, the guide pipe 30, the coil unit 40, and the cover 50 that constitute the oil-immersed solenoid 1. FIG. 14 does not show the biasing force adjusting mechanism 60.

To assemble the oil-immersed solenoid 1, first, the casing 10, the plunger 20, the guide pipe 30, the coil unit 40 integrated with the yoke 47, and the cover 50 are prepared, the sealing member 18 is attached to the annular groove 15*a* of the casing 10, and the sealing member 58 is attached to the first groove 51*a* of the cover 50. Then, as shown in FIG. 14, the plunger 20, the guide pipe 30, the coil unit 40, and the cover 50 are sequentially assembled in the cylinder 12 of the casing 10.

Specifically, the plunger 20 is attached in the cylinder 12 of the casing 10 so as to insert the shaft 21 into the insertion hole 15*d* of the fixed magnetic pole 15, the guide pipe 30 is fitted to the outer circumferences of the fixed magnetic pole 15 and the plunger 20, the coil unit 40 is fitted to the outer circumference of the guide pipe 30, and the cover 50 is attached to cover the guide pipe 30 and the coil unit 40.

After that, in the state where the plunger 20, the guide pipe 30, the coil unit 40, and the cover 50 are attached in the cylinder 12 of the casing 10, the front end 12*b* of the cylinder 12 is swaged to the cover 50 by using a swaging die not shown, to hold the plunger 20, the guide pipe 30, the coil unit 40, and the cover 50 in the casing 10.

After the oil-immersed solenoid 1 is assembled in this manner, the biasing force adjusting mechanism 60 is attached. Then, the oil-immersed solenoid 1 is assembled to a valve device not shown, and hydraulic oil is supplied into the space 24. It is noted that the oil-immersed solenoid 1 may not have the biasing force adjusting mechanism 60.

As described above, in the oil-immersed solenoid 1 in the present embodiment, by integrating the fixed magnetic pole 15 with the casing 10 or attaching the fixed magnetic pole 15 to the casing 10, attaching the plunger 20 in the cylinder 12 of the casing 10, fitting the guide pipe 30 to the outer circumferences of the fixed magnetic pole 15 and the plunger 20, fitting the coil unit 40 to the outer circumference of the guide pipe 30, attaching the cover 50 so as to cover the guide pipe 30 and the coil unit 40, and swaging the front end 12*b* of the cylinder 12 to the cover 50, the plunger 20, the guide pipe 30, the coil unit 40, and the cover 50 are held in the casing 10. Since the solenoid 1 can be assembled so easily by sequentially inserting the plunger 20, the guide pipe 30, the coil unit 40, and the cover 50 into the casing 10 and then, swaging the front end 12*b* of the cylinder 12 of the casing 10 as described above, the number of man-hours for assembling can be greatly decreased to reduce assembling costs.

Since the coil unit 40 has the recesses 46*b* in the end face 46*a* opposed to the base 11 of the casing 10, and the projections 46*c* protruding from the bases of the recesses 46*b* further than the end face 46*a* in the recesses 46*b*, when the front end 12*b* of the cylinder 12 of the casing 10 is swaged to the cover 50, the projections 46*c* of the coil unit 40 are squashed by the base 11 of the casing 10 such that the coil unit 40 is held by the casing 10, thereby holding the coil unit 40 at the predetermined position to suppress rattle. Further, it is possible to prevent the coil unit 40 from oscillating when an external load acts on the solenoid 1.

Although the grooves 52*b* axially dented from the edge of the top face 52 of the cover 50 are formed by cutting the protrusion 52*a* protruding from the top face 52 in the present embodiment, grooves axially dented from the top face 52 may be formed.

The present invention is not limited to the illustrated embodiment, and may be variously improved and changed in design so as not to deviate from the subject matter of the present invention.

INDUSTRIAL APPLICABILITY

As has been described, since the oil-immersed solenoid according to the present invention can be easily assembled to greatly decrease the number of man-hours for assembling and reduce assembling costs, the present invention can be preferably applied to the manufacturing of the oil-immersed solenoid or hydraulic equipment equipped with the oil-immersed solenoid.

DESCRIPTION OF REFERENCE SYMBOLS

1 OIL-IMMERSED SOLENOID
10 CASING
11 BASE
12 CYLINDER
13 FLANGE
15 FIXED MAGNETIC POLE
20 PLUNGER
21 SHAFT
22 ARMATURE
30 GUIDE PIPE
31 LARGE-DIAMETER PORTION
32 SMALL-DIAMETER PORTION
40 COIL UNIT
41 COIL
42 BOBBIN
46 MAIN BODY
47 YOKE
50 COVER

The invention claimed is:

1. An oil-immersed solenoid used for hydraulic control equipment, the oil-immersed solenoid comprising:

a casing including a base, a cylindrical cylinder extending from the base, and a flange extending from the base to an outside of the cylinder in an integral manner;

a fixed magnetic pole disposed to extend from the base into the cylinder;

a plunger including a shaft inserted into an insertion hole extending along an axis of the fixed magnetic pole, and an armature to which the shaft is fixed;

a cylindrical guide pipe fitted to an outer circumference of the fixed magnetic pole to cover the plunger;

a coil unit including a main body around which a coil is wound, and a connector provided on an outer circumferential face of the main body; and a cover disposed in the cylinder to cover the guide pipe and the coil unit from an opposite side to the base of the casing, wherein the fixed magnetic pole is integrated with the casing or the fixed magnetic pole is attached to the casing, the cylinder of the casing has a notch cut in a circumferential direction to correspond to the connector of the coil unit, and the plunger is attached in the cylinder of the casing so as to insert the shaft into the insertion hole of the fixed magnetic pole, the guide pipe is fitted to the outer circumference of the fixed magnetic pole to cover the plunger, the coil unit is inserted into a gap between the cylinder of the casing and the guide pipe, the cover is attached to cover the guide pipe and the coil unit, and in this state, a front end of the cylinder is swaged to the cover, to hold the plunger, the guide pipe, the coil unit, and the cover in the casing.

2. The oil-immersed solenoid according to claim 1, wherein a yoke is integrated with the coil unit, the yoke disposed adjacent to the main body on a side where the cover is arranged, and having an outer circumference of a larger outer diameter than the coil unit, and a step engaged with the outer circumference of the yoke is formed on an inner face of the cylinder of the casing.

3. The oil-immersed solenoid according to claim 1, wherein the coil unit has a recess in its opposed face to the base of the casing, and a projection protruding from the base of the recess further than the opposed face, in the recess.

4. The oil-immersed solenoid according to claim 1, wherein the cover has a protrusion protruding from an edge of a face of the cover, the face making contact with the front end of the cylinder when the front end of the cylinder is swaged.

5. The oil-immersed solenoid according to claim 1, wherein the cover has a groove on an edge of a face of the cover, the face making contact with the front end of the cylinder when the front end of the cylinder is swaged, the groove being axially dented further than a remaining area of the edge.

6. The oil-immersed solenoid according to claim 1, wherein the guide pipe includes a large-diameter portion fitted to the fixed magnetic pole and a small-diameter portion fitted to the armature of the plunger, and both axial ends of the small-diameter portion are pressed by hydraulic oil.

* * * * *